US006241693B1

(12) United States Patent
Lambden

(10) Patent No.: US 6,241,693 B1
(45) Date of Patent: Jun. 5, 2001

(54) METHOD AND APPARATUS FOR APPLYING ACUPRESSURE

(76) Inventor: Brian D. Lambden, P.O. Box 729, Englewood, CO (US) 80151

( * ) Notice: Subject to any disclaimer, the term of this patent is extended or adjusted under 35 U.S.C. 154(b) by 0 days.

(21) Appl. No.: 09/070,539

(22) Filed: Apr. 30, 1998

(51) Int. Cl.[7] ..... A61H 15/00; A61H 7/00

(52) U.S. Cl. ..... 601/15; 601/19; 601/119; 601/120; 601/129; 601/135

(58) Field of Search ..... 601/15, 19, 118, 601/119, 120, 129, 133–138; 15/244.1, 110, 222; 606/204

(56) References Cited

U.S. PATENT DOCUMENTS

| | | | | |
|---|---|---|---|---|
| 2,168,842 | * | 8/1939 | Kesteven et al. | 601/118 |
| 3,707,284 | | 12/1972 | Waldeck . | |
| 3,856,002 | | 12/1974 | Matsumoto . | |
| 4,008,715 | | 2/1977 | Brodbeck . | |
| 4,082,089 | * | 4/1978 | Moriyama et al. | 601/19 |
| 4,266,536 | | 5/1981 | Casares . | |
| 4,411,421 | | 10/1983 | Hershberger . | |
| 4,798,198 | | 1/1989 | Wright . | |
| 4,846,159 | | 7/1989 | Anzai et al. . | |
| 5,211,162 | | 5/1993 | Gillen, Jr. et al. . | |
| 5,364,338 | * | 11/1994 | Terashima | 601/118 X |
| 5,393,298 | * | 2/1995 | Chang | 601/134 |
| 5,560,746 | * | 10/1996 | Willow . | |
| 5,730,708 | * | 3/1998 | Spratt . | |

FOREIGN PATENT DOCUMENTS

| | | | | |
|---|---|---|---|---|
| 664915 | * | 9/1929 | (FR) | 601/120 |
| 1466748 | * | 3/1989 | (SU) | 601/119 |

* cited by examiner

*Primary Examiner*—Danton D. DeMille
(74) *Attorney, Agent, or Firm*—Sheridan Ross P.C.

(57) ABSTRACT

An apparatus and a method for applying pressure to the body of a person is disclosed. The apparatus comprises an arcuate shaft, a handle that extends from the arcuate shaft in a plane intersecting the plane of the arcuate shaft, and a pressure applicator movably attached to the arcuate shaft for applying pressure to the body. The apparatus can be used for massaging or for applying acupressure.

19 Claims, 2 Drawing Sheets

METHOD AND APPARATUS FOR APPLYING ACUPRESSURE

FIELD OF THE INVENTION

The present invention relates to an apparatus and method for applying a pressure to a desired portion of the body of a person. More particularly, the present invention relates to an apparatus and method for massaging or for applying acupressure on parts of the body which are difficult to reach.

BACKGROUND OF THE INVENTION

The benefits of massage and acupressure have been known for centuries. Massage as a form of therapy has been used by almost all cultures for thousands of years, dating back to the ancient Greeks and Romans where Hippocrates extolled its virtues as a form of medical treatment. There are currently over 100 different types of massage therapy being practiced today. Acupressure is a specific type of massage, dating back over 5,000 years in ancient China. The technique consists of applying localized pressure to specific points on the body as opposed to acupuncture which inserts needles into these same points. The effects of acupressure and acupuncture are similar. Studies have demonstrated that acupuncture stimulates the nervous system, causing alterations in the amount of neurotransmitters and/or neurohormones released, thus resulting in changes in blood flow, immune function and/or pain perception. The effects of massage and acupressure such as reduction in pain, muscle tension and stress are well documented.

Other physical methods which have been scientifically proven to reduce pain and muscle spasm include physical modalities such as applying heat or cold. In addition, recent medical studies have demonstrated that treatment with magnetic fields reduces muscular pain and is useful in treating persistent neck pain. See, for example, *Vallbona, Arch. Phys. Med. Rehabil.* 1997, 78, 11 and *Orthopedics* 1990, 13(4), 445. Treatment with these types of modalities typically requires daily treatment. In fact, most types of pain and spasm respond better to daily treatment whether it is by physical modalities or massage. Indeed, many instructors of ancient healing arts and physical therapists instruct their clients on self management of pain using techniques of self massage, self acupressure or other self administered physical modalities. Thus, with most injuries it is advantageous to be able to self-treat the painful area.

With regard to muscular pain, it is common to have pain or spasm over the back of the neck and extending down to the lower back. Unfortunately, these areas are difficult to reach if one is to attempt self-treatment. There are some devices designed to allow the user to massage the back portion of the body as disclosed by Casares in U.S. Pat. No. 4,266,536, Wright in U.S. Pat. No. 4,798,198 and Matsumoto in U.S. Pat. No. 3,856,002. These devices typically massage a small portion of the back at a time and can be difficult to use or control in certain areas of the body. In addition, these devices are not designed to take advantage of heat, cold or magnetism during acupressure treatment. Moreover, these devices are not designed with a detachable pressure applicator member that can be used separately from the device.

Therefore, there is a need for a massage apparatus and a method which permits the user to apply different types of pressure and physical modalities to various parts of the body without any assistance in a simple, economical, yet effective manner.

SUMMARY OF THE INVENTION

The present invention relates to an apparatus and a method for easy application of various types of pressure to various portions of the user's body without assistance from another person.

The apparatus comprises an arcuate shaft substantially defining a plane, a handle extending from the arcuate shaft and protruding from the plane of the arcuate shaft, and a pressure applicator movably attached to the arcuate shaft for applying pressure to a body. The arcuate shaft has at least two different radii of curvature which are adaptable for applying pressure to various parts of the body. The first radius of curvature is preferably from about 30 cm to about 60 cm, more preferably from about 36 cm to about 54 cm, and most preferably from about 40 cm to about 50 cm. Preferably, the second radius of curvature is from about 12 cm to about 21 cm, more preferably from about 14 cm to about 19 cm, and most preferably from about 15 cm to about 18 cm.

The pressure applicator can be a stationary pressure applicator, a roller or a combination thereof. The position of the pressure applicator can be adjusted along the arcuate shaft such that it can be adapted to be used in various areas of the body. The stationary pressure applicator comprises a base and a direct pressure head. The direct pressure head can be heated or cooled to allow applying hot or cold acupressure, respectively. The direct pressure head can comprise a magnet to allow for application of magnetic therapy. Furthermore, the stationary pressure applicator can be removed from the arcuate shaft and used by itself or with a small bar to treat more accessible areas.

Another embodiment of the present invention is a method for applying pressure on the body of a person which comprises placing the above described apparatus around the desired portion of the body of the person and applying pressure on the arcuate shaft such that the pressure applicator contacts and exerts a desired amount of pressure on the desired portion of the body of the person. The apparatus can be moved upwardly and/or downwardly along the body of the person for massaging or it can be used to apply acupressure on a desired part of the body.

DETAILED DESCRIPTION OF THE INVENTION

The present invention will be described with regard to the accompanying drawings which assist in illustrating various features of the invention. In this regard, the present invention generally relates to a method and an apparatus for applying pressure to various portions of the user's body without the need for assistance.

Figure 1:
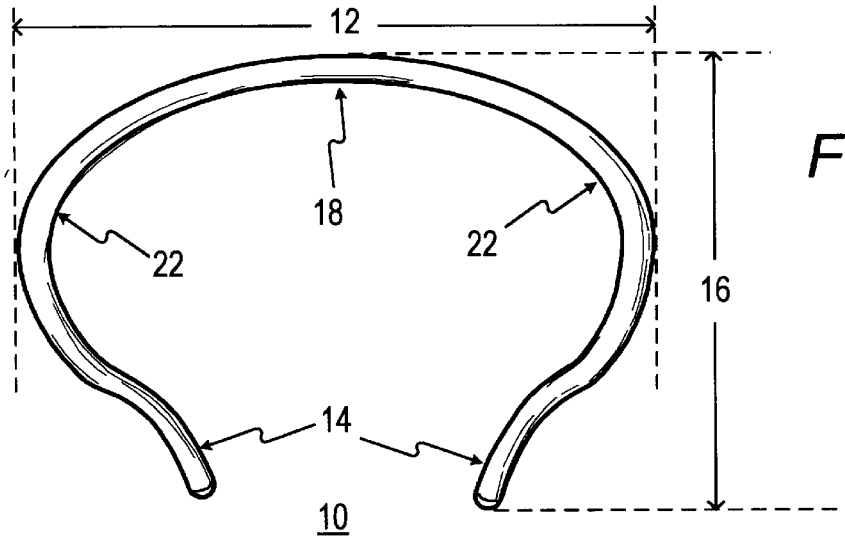
FIG. 1 is a top view of an arcuate shaft of the present invention.
Figure 2:
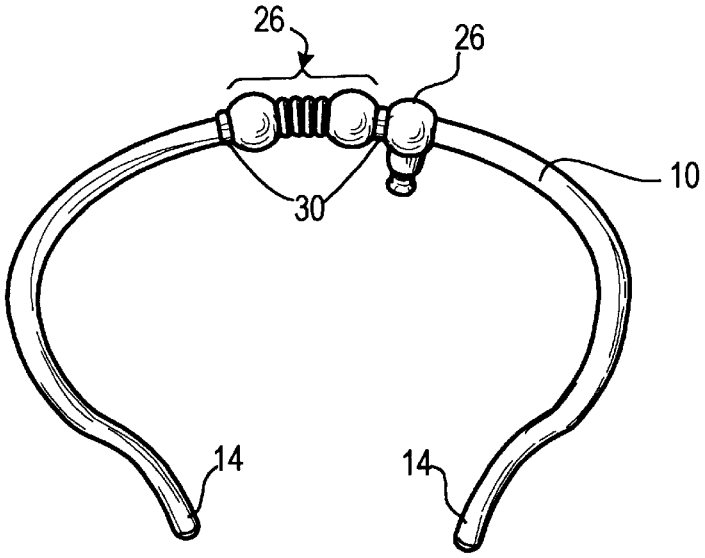
FIG. 2 is a top view of an apparatus of the present invention having a plurality of rollers for massaging a person's body.
Figure 3:
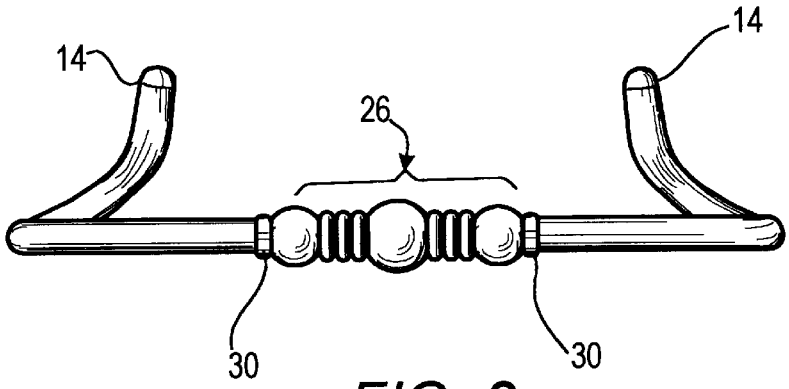
FIG. 3 is a rear view of an apparatus of the present invention having a plurality of rollers for massaging a person's body.

A particular embodiment of an apparatus for applying pressure to various parts of the body is illustrated in FIGS. 1–3. The apparatus comprises an arcuate shaft 10, one or more handles 14, and one or more pressure applicators 26 movably attached to the arcuate shaft 10 for applying pressure to the body. In a particularly useful embodiment, the arcuate shaft 10 is a bar. As used in this invention, a "bar" refers to a shaft wherein its cross-section is substantially a circle or an ellipse having a diameter of from about 1 cm to about 5 cm, more preferably from about 2 cm to about 4 cm, and most preferably from about 2 cm to about 3 cm. A "bar" can be a solid or a hollow tube in which case the above diameter refers to the outer diameter of the tube. Although a wide variety of dimensions are possible, to accommodate people of a variety of sizes, in one particular embodiment of the present invention the overall length, i.e., the length from the beginning of one handle to the other handle, of the arcuate shaft 10 is from about 100 cm to about 200 cm, more preferably from about 125 cm to about 175 cm, and most preferably from about 140 cm to about 160 cm. The width 12 of the arcuate shaft 10, in its final curved configuration, is from about 40 cm to about 80 cm, preferably from about 50 cm to about 70 cm, and more preferably from about 55 cm to about 65 cm. The length 16 of the arcuate shaft 10, in its final curved configuration, is from about 20 cm to about 60 cm, preferably from about 30 cm to about 50 cm, and more preferably from about 35 cm to about 45 cm.

The arcuate shaft 10 comprises a first portion having a first radius of curvature 18 and a second portion having a second radius of curvature 22, which is different from the first radius of curvature 18. Although the first radius of curvature 18 is adapted to be suitable for applying pressure to a wide area of the body such as a person's back, it can be used for applying a pressure to a small portion of the body such as the neck or thigh as well. The first radius of curvature 18 is typically located in the middle portion of the arcuate shaft 10. Preferably, the first radius of curvature 18 is from about 30 cm to about 60 cm, more preferably from about 36 cm to about 54 cm, and most preferably from about 40 cm to about 50 cm.

The second radius of curvature 22 is generally selected to be suitable for applying pressure to a narrower area of the body than the first radius of curvature 18, e.g., the neck or a thigh. Thus, the second radius of curvature 22 is smaller than the first radius of curvature 18. The second radius of curvature 22 is typically located in the outer portion of the arcuate shaft 10 near the handle 14. Preferably, the second radius of curvature 22 is from about 12 cm to about 21 cm, more preferably from about 14 cm to about 19 cm, and most preferably from about 15 cm to about 18 cm.

The arcuate shaft 10 can be made of any firm material including a plastic such as polyvinyl chloride (PVC), polycarbonate, polyacetal, polyamide, nylon, acrylylnitrile-butadiene-styrene copolymer, and polyurethane; wood; metal, such as aluminum, steel, brass and copper; or a combination thereof. Preferably, the arcuate shaft 10 is comprised of a plastic. In a particularly preferred embodiment, the arcuate shaft 10 is a PVC tube having an outer diameter of about 0.84 inches (2.1 cm) and an inner diameter of about 0.5 inches (1.3 cm). The arcuate shaft 10 is rigid to substantially maintain its structural integrity when a pressure is applied. The arcuate shaft 10 can have some flexibility to prevent complete transfer of pressure to the pressure applicator 26 which can cause pain to the user.

The arcuate shaft 10 is generally elliptical and substantially defines a plane. However, it should be appreciated that the arcuate shaft 10 can be slightly bowed and still substantially define a plane. The handle 14 protrudes from the plane of the arcuate shaft 10. The position of the handle 14 allows the user to easily move the apparatus upwardly and/or downwardly along the desired portion of the user's body. Preferably, the protrusion of the handle 14 is substantially perpendicular to the plane of the shaft 10. As used in this invention, "substantially perpendicular" refers to an angle of from about 45° to about 90°, more preferably from about 50° to about 80°, and even more preferably from about 60° to about 70°.

The handle 14 can be made from a material that is different from the arcuate shaft material or it can simply be an end portion of a bar that is bent to provide a protrusion above the general plane of the arcuate shaft 10, i.e., a bar can form both the arcuate shaft 10 and the handle 14. To provide additional comfort to the user, the handle 14 can be covered with a material such as foam, fabric, rubber, polystyrene, leather, or a combination thereof. The handle 14 can be textured or shaped to provide a non-slip grip.

The apparatus of the present invention also comprises a means for applying pressure to a desired portion of one's body. A means for applying pressure can be any device which provides pressure to a desired portion of a body. Preferably, the means for applying a pressure comprises a pressure applicator 26. Preferably, the pressure applicator 26 is selected from the group consisting of rotatable pressure applicators (or rollers), stationary pressure applicators, and a combination thereof. The pressure applicator 26 can be positioned anywhere along the arcuate shaft 10. The placement of the pressure applicator 26 on the arcuate shaft 10 depends on the particular area of the body to which the user desires to apply a pressure. As used in this invention, "applying pressure" refers to act of massaging or applying acupressure to a desired portion of one's body. For applying pressure on the back, typically the user places the pressure applicator 26 along the first radius of curvature 18, e.g., near the middle portion of the arcuate shaft 10. For applying pressure on a smaller portion of the body, such as the neck area, it is desirable to place the pressure applicator 26 along the second radius of curvature 22, e.g., the arcuate shaft area near the handle 14.

The apparatus of the present invention can also be used to apply a direct pressure to a desired portion of one's body. As used in this invention, applying a "direct pressure" means applying pressure to a particular spot. A direct pressure can be applied by having direct contact between the pressure applicator 26 and the body, or it can involve contact between the pressure applicator 26 and the body with clothes or other material such as a towel, a heat-pack or a cold-pack placed in between the pressure applicator 26 and the body. The pressure applicator 26 can be fabricated from any material that has sufficient strength to exert a force on the body by manipulation of the arcuate shaft 10. Preferably, the pressure applicator 26 is made from a material selected from the group consisting of metal, wood, foam, plastic, rubber, ceramic, and a combination thereof.

The pressure applicator 26 can be rotatable or it can be stationary. Typically, a rotatable pressure applicator is used for massaging a body and a stationary pressure applicator is used for applying a direct pressure to a body. The rotatable pressure applicator is typically a roller that has an outer diameter and an inner diameter. The inner diameter of the roller is larger than the diameter of the arcuate shaft 10 such that the roller can be slid on to a desired location of the arcuate shaft 10. Alternatively, the roller can include a bearing which can be securely fastened on to the arcuate shaft 10 to provide rotation of only the outer portion of the roller without the entire roller being rotated around the arcuate shaft 10. The rotational axis of the roller is essentially the center axis of the arcuate shaft 10 on which the roller is located. The roller can be any shape which provides pressure and rotates when the apparatus is moved upwardly and/or downwardly along one's body. Preferably the shape of the roller is selected from the group consisting of cylinder-shaped, ball-shaped, or wheel-shaped. The number of rollers and the shape of each roller can vary depending on the particular portion of the body where the pressure is applied. The size of a roller can also vary depending on the amount of area of the body which the user desires to apply a pressure. For a roller that is ball-shaped, preferably the diameter of the roller is from about 3.2 cm to about 7.6 cm, more preferably from about 3.8 cm to about 5.0 cm, and most preferably from about 4.4 cm to about 4.8 cm. It has been found that a ball-shaped roller having diameter of about 1.75 inches (4.45 cm) are particularly useful for applying pressure to a wide variety of areas of the body. For a roller that is wheel-shaped, preferably the diameter of the roller is from about 3.2 cm to about 7.6 cm, more preferably from about 3.8 cm to about 6.4 cm, and most preferably from about 4.4 cm to about 5.7 cm. The width of a wheel-shaped roller is preferably from about 0.5 cm to about 2.0 cm, more preferably from about 0.75 cm to about 1.75 cm, and most preferably from about 1.0 cm to about 1.5 cm. A wheel-shaped roller having a diameter of about 2 inches (5.1 cm) and thickness (i.e., width) of about 0.5 inches (1.3 cm) have been found to be particularly useful.

After placing the pressure applicator 26 on to the arcuate shaft 10, the position of the pressure applicator 26 on the arcuate shaft 10 can be fixed by placing a stopper 30 next to the pressure applicator 26. The stopper 30 prevents unwanted movement of the pressure applicator 26 along the arcuate shaft 10. The stopper 30 itself is secured to the arcuate shaft 10 by any means which prevents an undesired movement of the stopper along the arcuate shaft 10. For example, the stopper 30 can be secured to the arcuate shaft 10 by a screw, a nut and bolt mechanism, a hook and loop mechanism, or it can simply be secured to the arcuate shaft 10 by a friction between the stopper 30 and the arcuate shaft 10. For example, the stopper 30 can be an elastic member such as rubber with its natural diameter smaller than the diameter of the arcuate shaft 10. A "natural diameter" refers to the diameter of the stopper 30 in its natural state, i.e., unstretched state. To be effective, the outer diameter of the stopper 30 when placed on the arcuate shaft 10 is larger than the inner diameter of the pressure applicator 26. In this manner, the friction between the stopper 30 and the arcuate shaft 10 prevents the pressure applicator 26 from moving along the arcuate shaft 10.

Figure 4A:
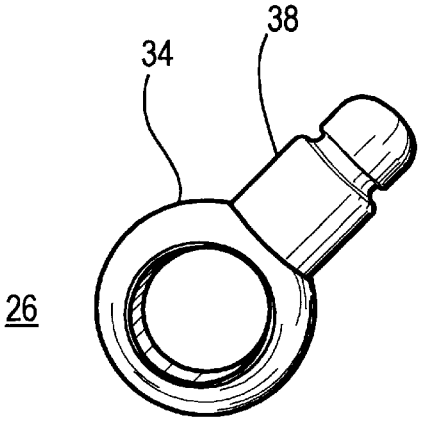
FIG. 4A is a perspective view of a stationary pressure applicator of the present invention.
Figure 4B:
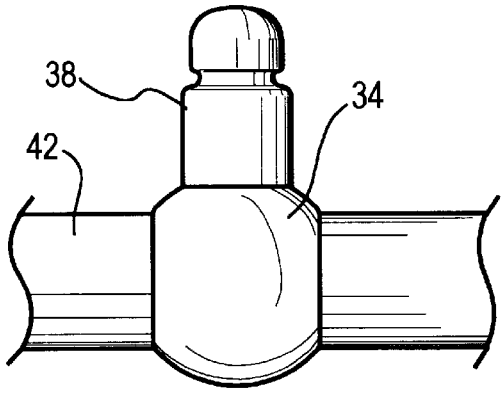
FIG. 4B is a perspective view of a stationary pressure applicator of the present invention that is attached to a bar.

When a direct pressure, e.g., acupressure, is desired, a stationary pressure applicator can be used. A stationary pressure applicator is any pressure applicator that is designed such that when it is placed and secured on the arcuate shaft 10, it does not rotate along the center axis of the arcuate shaft where the pressure applicator is located when the apparatus is moved upwardly and/or downwardly along one's body. FIG. 4A shows a particular embodiment of a stationary pressure applicator of the present invention. Preferably, the stationary pressure applicator comprises a base 34 and a direct pressure head 38. As indicated by label 42 in FIG. 4B, the stationary pressure applicator can be used with the arcuate shaft or a relatively short straight bar, which provides a secure grip of the stationary pressure applicator. Or one can be use the stationary pressure applicator separately by itself.

The stationary pressure applicator can be one piece or it can comprise two or more separate components which can be interconnected. In a particularly useful embodiment, the stationary pressure applicator comprises two separate components, e.g., the base 34 and the direct pressure head 38 are separate elements which are interconnected by a means which securely attaches the direct pressure head 38 to the base 34. The means for securely attaching the direct pressure head 38 to the base 34 can be any device which provides attachment of the direct pressure head 38 to the base 34. A means for attaching the direct pressure head 38 to the base 34 includes a nut and bolt mechanism, a hook and loop mechanism, magnetic mechanism, a screw, and a pin and slot mechanism.

Figure 5A:
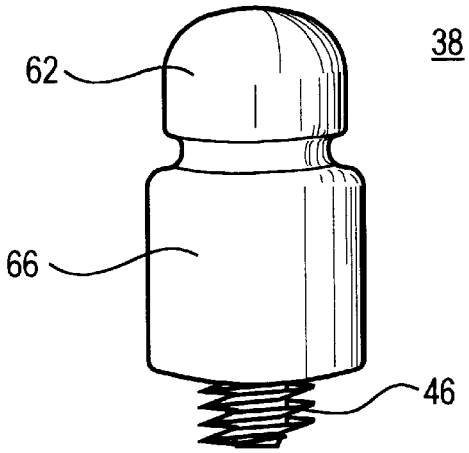
FIG. 5A is a perspective view of a direct pressure head of the present invention.
Figure 5B:
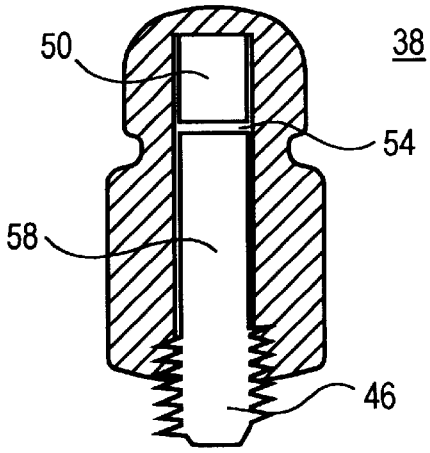
FIG. 5B is a cross-sectional view of a direct pressure head of the present invention.

FIGS. 5A and 5B show a particular embodiment of the direct pressure head 38 of the present invention. In a stationary pressure applicator having two separate elements for the base 34 and the direct pressure head 38, the direct pressure head 38 comprises a bolt 46 having a male-thread which can be attached to a corresponding female-thread on the base 34 (not shown) to securely attach the direct pressure head 38 to the base 34. Although the stationary pressure applicator can be secured to the arcuate shaft 10 or the bar 42 by any means discussed above for securing the pressure applicator 26, in a particularly useful embodiment of the present invention, the length of the bolt 46 on the direct pressure head 38 is slightly longer than the depth of the corresponding female-thread present in the base 34. In this manner, the bolt 46 itself provides a means for securing the stationary pressure applicator to the arcuate shaft 10 or the bar 42 by providing sufficient friction between the bottom surface of the bolt 46 and the arcuate shaft 10 or the bar 42.

The direct pressure head 38 can be cooled or heated to a desired temperature prior to being used for applying pressure to a body. In this manner, cold or hot pressure can be applied to a desired portion of the body. The direct pressure head 38 can be made from any rigid material. Preferably the contact point is made from a material selected from the group consisting of metal, ceramic, plastic, rubber, wood, and a combination thereof. Preferably the direct pressure head 38 has thermal conductance of from about 0.1 Cal-$K^{-1}$ $cm^{-1}$ $s^{1}$ to about 0.95 Cal-$K^{-1}$ $cm^{-1}$ $s^{-1}$, more preferably from about 0.5 Cal-$K^{-1}$ $cm^{-1}s^{-}$ to about 0.95 Cal-$K^{-1}$ $cm^{-1}$ $s^{-1}$, and most perferably about 0.8 Cal-$K^{-1}$ $cm^{-1}$ $s^{-1}$ to about 0.95 Cal-$K^{-1}$ $cm^{-1}$ $s^{-1}$. Materials which meet these requirements are typically a metal. A direct pressure head 38 which is derived from metal is particularly useful because it can be cooled or heated rapidly prior to or during the use. Useful metals for the direct pressure head 38 include copper, nickel, iron, gold, silver, titanium, iron, aluminum, zinc, and a combination thereof.

In a temperature dependent therapeutic use of the apparatus of the present invention, the upper portion 62 of the direct pressure head 38 contacts the desired portion of the body. The useful temperature range for heat or cold therapy is fairly narrow. Thus, to allow a prolonged use of the apparatus of the present invention in heat or cold therapy, the direct pressure head 38 is designed in such a way that the lower portion 66 of the direct pressure head 38 has enough heat or cold storage capacity to retain the heat or cold. One method of providing a longer temperature therapeutic use is to provide the upper portion 62 of the direct pressure head 38 to be smaller than the lower portion 66. This provides a steady flow of heat/cold from the lower portion 66 to the upper portion 62 and results in a substantially constant temperature at the upper portion 62 so that the desired portion of the body is exposed to a substantially constant temperature for a prolonged period. In addition or alternatively, an insulator can be placed in between the upper portion 62 and the lower portion 66 to control the rate of heat/cold transfer from the lower portion 66 to the upper portion 62. The amount of insulator between the upper portion 62 and the lower portion 66 depends on the desired heat/cold transfer rate between the two portions of the constant pressure applicator 38.

Typically, it is desirable that only a small area of the body be subjected to direct pressure at a time. Therefore, a diameter of the upper portion 62 is preferably from about 1 cm to about 5 cm, more preferably from about 1.5 cm to about 4 cm, and most preferably from about 2 cm to about 3 cm. It has been found that a direct pressure head having the upper portion 62 diameter of about 2 cm is particularly useful in direct pressure therapy.

The direct pressure head 38 can be one-piece or it can comprise an insert 58 as shown in FIG. 5B. The insert 58 can be permanently affixed to the direct pressure head 38 or it can be removable. When insert 58 is removable, the direct pressure head 38 can rotate along the center axis of the insert 58. Thus, although the stationary pressure applicator does not rotate along the axis of the arcuate shaft 10 or the bar 42, the direct pressure head 38 itself can rotate along the center axis of the insert 58.

The insert 58 can comprise a magnetic portion 50 for providing a magnetic field near the desired portion of the user's body. In a particularly useful embodiment of the present invention, the insert 58 is designed such that a permanent magnet is placed near the upper portion 62 of the direct pressure head 38 to provide a magnetic field at the desired portion of one's body.

The insert 58 can also comprise an insulator 54 which provides an insulating effect to control the rate of heat/cold transfer from the lower portion 66 to the upper portion 62 when the direct pressure head 38 is used in a temperature dependent therapy.

The stationary pressure applicator can also comprise a means for vibrating the direct pressure head 38. A means for vibrating the direct pressure head 38 is any device which causes the direct pressure head 38 to vibrate. A means for vibrating the direct pressure head 38 includes electrical devices which produce vibration.

Another embodiment of the present invention is a method of using the apparatus described herein. More particularly, the method is for applying pressure on the body of a person comprising the steps of placing the apparatus of the present invention around a portion of the body of the person and applying a pressure on the arcuate shaft 10 such that the pressure applicator 26 contacts the desired portion of the body of the person. The arcuate shaft 10 can be held essentially in one area to provide a direct pressure to a particular area of the body. Alternatively, the arcuate shaft 10 can be moved up and/or down the area of the body to massage a given area. The direction of the arcuate shaft 10 movement is relative to the long axis of the body of a person. Thus, a person can use the present apparatus while lying down on a table and move the shaft horizontally, but it is still considered moving the shaft "up and/or down" the body. The present invention is particularly useful for applying a direct pressure or massaging the neck or the back of a person since these areas are otherwise difficult to reach. Although the present invention is described as being useful for "self-treatment" purposes, it will be appreciated that the apparatus and methods of the present invention can be used by anyone to treat another person.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiment described hereinabove is further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An apparatus for applying pressure to the body of a person comprising:

a rigid arcuate shaft substantially defining a plane, wherein said arcuate shaft comprises a first portion having a first radius of curvature and a second portion having a second radius of curvature, wherein said first radius of curvature and said second radius of curvature are different;

a handle extending from said arcuate shaft and protruding from the plane of said arcuate shaft;

a pressure applicator comprising a roller for applying pressure to the body, wherein said pressure applicator is movably attached to said arcuate shaft; and a stopper secured on said arcuate shaft for positioning and preventing movement of said pressure applicator along said arcuate shaft.

2. The apparatus of claim 1, wherein said first radius of curvature is from about 30 cm to about 60 cm.

3. The apparatus of claim 1, wherein said second radius of curvature is from about 12 cm to about 21 cm.

4. The apparatus of claim 1, wherein said handle protrudes in a substantially perpendicular direction relative to the plane of said arcuate shaft.

5. The apparatus of claim 1, wherein said apparatus further comprises a stationary pressure applicator.

6. The apparatus of claim 5, wherein said stationay pressure applicator comprises a base and a direct pressure head.

7. The apparatus of claim 6, wherein said direct pressure head comprises a magnet.

8. The apparatus of claim 6, wherein the thermal conductivity of said direct pressure head is from about 0.1 Cal-$K^{-1}$ $cm^{-1}$ $s^{-1}$ to about 0.95 Cal-$K^{-1}$ $cm^{-1}$ $s^{-1}$.

9. The apparatus of claim 1, wherein the rotational axis of said roller is essentially the center axis of the portion of said arcuate shaft on which said roller is located.

10. The apparatus of claim 9, wherein the shape of said roller is selected from the group consisting of a substantially ball-shaped, cylindrically-shaped, and wheel-shaped.

11. The apparatus of claim 9, wherein said apparatus comprises a plurality of said rollers.

12. A method for applying pressure on the body of a person comprising the steps of:

(a) placing an apparatus around a desired portion of the body of the person, wherein said apparatus comprises:

a rigid arcuate shaft substantially defining a plane comprising a first portion having a first radius of curvature and a second portion having a second radius of curvature, wherein said first radius of curvature and said second radius of curvature are different;

a handle extending from said arcuate shaft and protruding substantially perpendicular to the plane of said arcuate shaft; and a pressure applicator roller movably attached to said arcuate shaft for applying pressure to the body; and a stopper secured on said arcuate shaft for positioning and preventing movement of said pressure applicator along said arcuate shaft; and (b) applying pressure on said arcuate shaft such that said pressure applicator contacts the desired portion of the body of the person.

13. The method of claim 12, wherein said pressure applicator comprises a plurality of rollers.

14. The method of claim 13 further comprising the step of moving said arcuate shaft upwardly and/or downwardly to massage the desired portion of the body of the person.

15. The method of claim 12, wherein said apparatus further comprises a stationary pressure applicator, wherein said stationary pressure applicator comprises a base and a direct pressure head, and wherein the thermal conductivity of said direct pressure head is from about 0.1 Cal-$K^{-1}$ $cm^{-1}$ $s^{-1}$ to about 0.95 Cal-$K^{-1}$ $cm^{-1}$ $s^{-1}$.

16. The method of claim 12, wherein the desired portion of the body of said person is the neck and/or the back of said person.

17. An apparatus for applying pressure to the body of a person comprising:

a rigid arcuate shaft substantially defining a plane comprising a first portion having a first radius of curvature and a second portion having a second radius of curvature, wherein said first radius of curvature and said second radius of curvature are different;

a handle extending from said arcuate shaft and protruding substantially perpendicular to the plane of said arcuate shaft; and a pressure applicator comprising a roller movably attached to said arcuate shaft for applying pressure to the body, wherein the rotational axis of said roller is essentially the center axis of the portion of said shaft on which said roller is located; and a stopper moveably attached to said arcuate shaft for positioning and preventing unwanted movement of said pressure applicator along said arcuate shaft.

18. The apparatus of claim 17, wherein said pressure applicator comprises a plurality of said rollers.

19. The apparatus of claim 17, wherein said apparatus further comprises a stationary pressure applicator, wherein said stationary pressure applicator comprises a base and a direct pressure head.

* * * * *